US010462550B2

(12) United States Patent
Nie et al.

(10) Patent No.: US 10,462,550 B2
(45) Date of Patent: Oct. 29, 2019

(54) STORAGE DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Yan-Bo Nie, Shenzhen (CN); Wei Wu, Shenzhen (CN); Tao Jiang, Shenzhen (CN); Tzu-Nung Chou, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 77 days.

(21) Appl. No.: 15/870,885

(22) Filed: Jan. 13, 2018

(65) Prior Publication Data

US 2019/0110118 A1 Apr. 11, 2019

(30) Foreign Application Priority Data

Oct. 11, 2017 (CN) ..... 2017 2 1311536 U

(51) Int. Cl.
*H04R 1/10* (2006.01)
*B65D 85/672* (2006.01)

(52) U.S. Cl.
CPC ..... *H04R 1/1033* (2013.01); *B65D 85/672* (2013.01)

(58) Field of Classification Search
CPC .... H04R 1/1033; B65D 85/672; H02G 11/02; B65H 2701/3919; B65H 75/08; H04M 1/15
USPC ..... 206/702; 191/12.2 R; 242/378.3
See application file for complete search history.

(56) References Cited

U.S. PATENT DOCUMENTS

| | | | | |
|---|---|---|---|---|
| 5,772,152 | A * | 6/1998 | Maldonado | B65H 75/38 242/386 |
| 6,616,080 | B1 * | 9/2003 | Edwards | A45C 7/0045 191/12.2 R |
| 7,546,969 | B2 * | 6/2009 | Kuramoto | B65H 75/406 242/118.2 |
| 8,967,518 | B2 * | 3/2015 | Guo | B65H 75/4431 242/378 |
| 2003/0201358 | A1 * | 10/2003 | Ting | B65H 75/4473 242/388.1 |
| 2015/0207304 | A1 * | 7/2015 | Tracey | B65H 75/4471 242/390.9 |
| 2016/0020594 | A1 * | 1/2016 | Nooner | H02G 15/115 206/702 |

* cited by examiner

*Primary Examiner* — Steven A. Reynolds
(74) *Attorney, Agent, or Firm* — ScienBiziP, P.C.

(57) ABSTRACT

A storage device includes a first case, a second case, and a winding body. The first case includes a first connecting portion. The second case includes a second connecting portion. The winding body winds an object thereon. The first connecting portion is slidably coupled within the second connecting portion. The winding body is sleeved over the second connecting portion.

9 Claims, 7 Drawing Sheets

STORAGE DEVICE

CROSS-REFERENCE TO RELATED APPLICATIONS

This application claims priority to Chinese Patent Application No. 201721311536.0 filed on Oct. 11, 2017, the contents of which are incorporated by reference herein.

FIELD

The subject matter herein generally relates to storage devices, and more particularly to a storage device for storing wired earphones.

BACKGROUND

Generally, wired earphones are easily tangled when not in use, which may reduce a life of the wired earphones.

BRIEF DESCRIPTION OF THE DRAWINGS

Implementations of the present disclosure will now be described, by way of example only, with reference to the attached figures.

DETAILED DESCRIPTION

Figure 1:
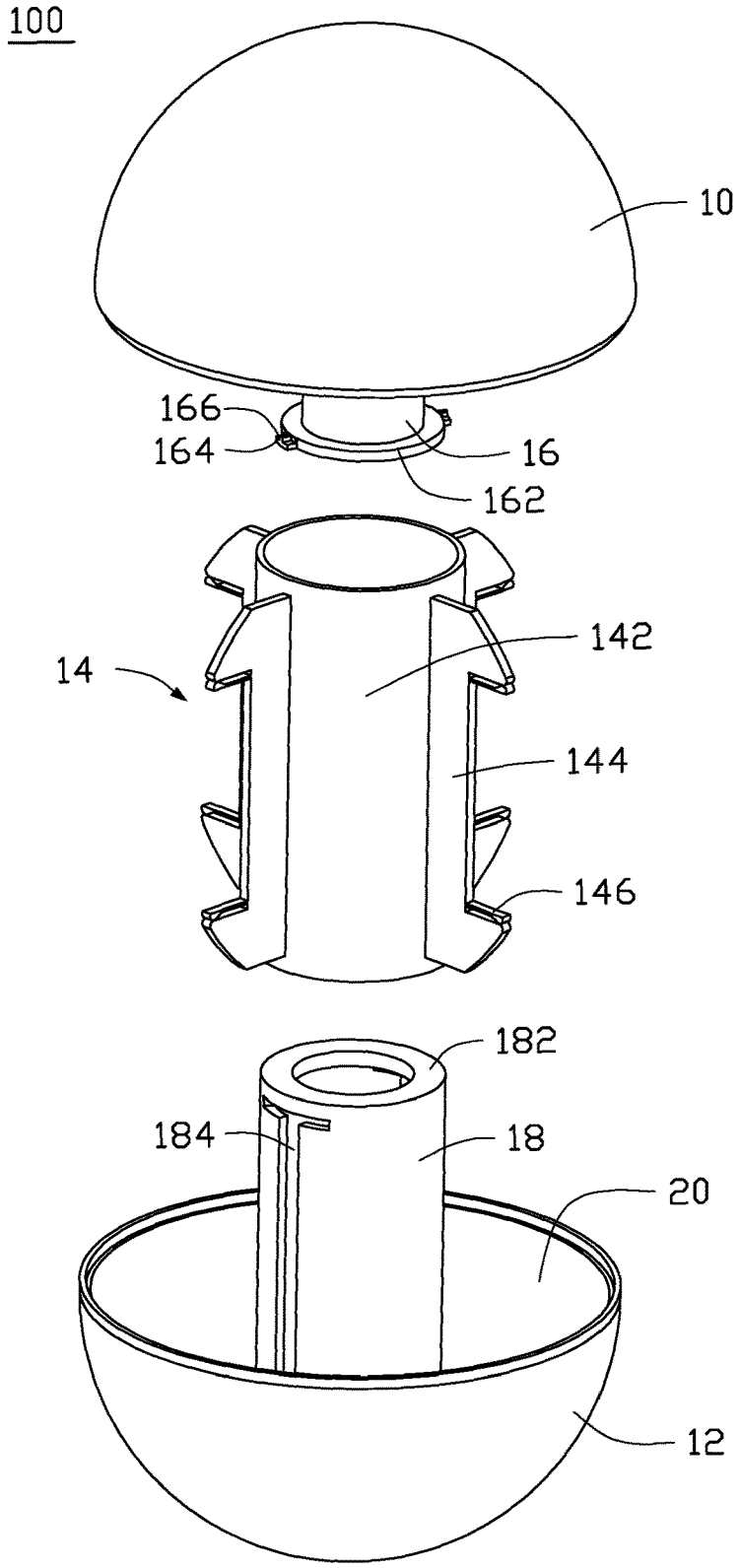
FIG. 1 is an exploded, isometric view of an exemplary embodiment of a storage device in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 7:
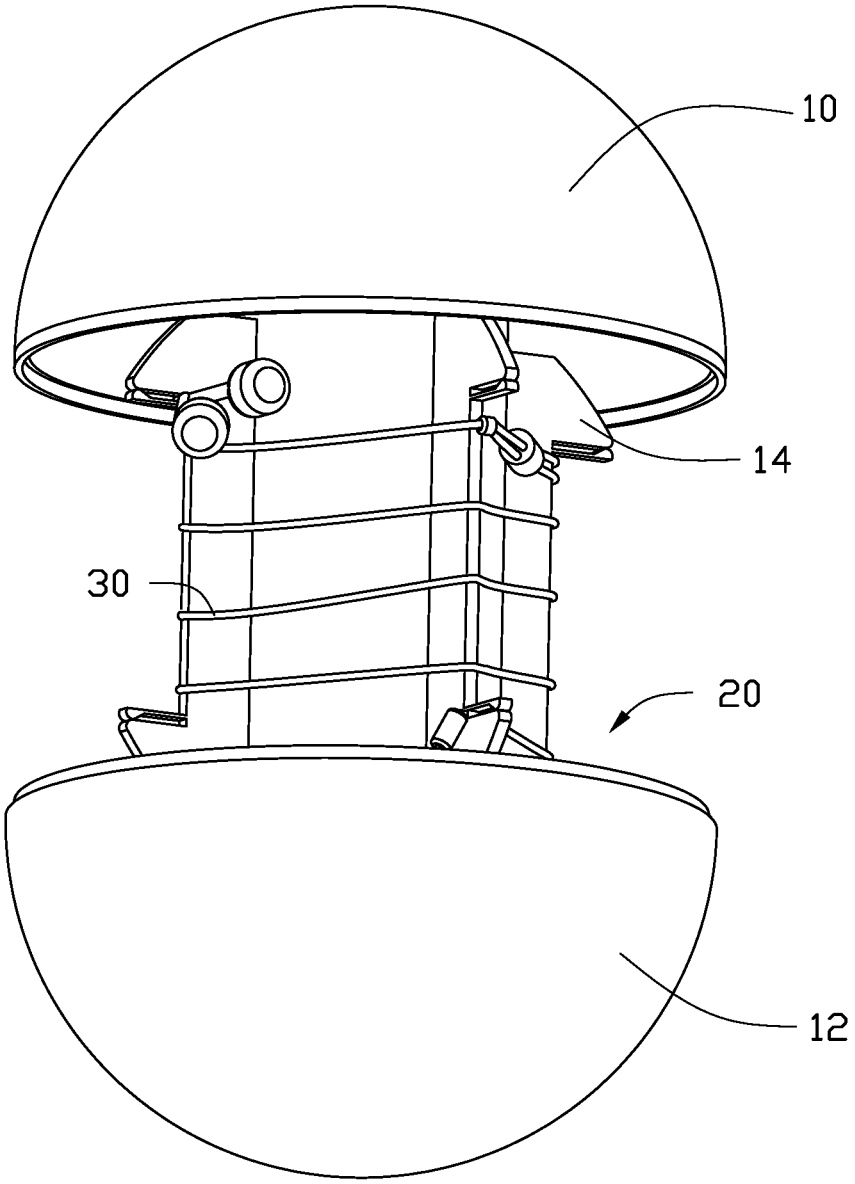
FIG. 7 is an isometric view of the storage body in the open state with wired earphones.

FIG. 1 illustrates an embodiment of a storage device 100 for storing wired earphones 30 (shown in FIG. 7). The storage device 100 includes a first case 10, a second case 12, and a winding body 14.

In at least one embodiment, the first case 10 is substantially semispherical. The first case 10 includes a first connecting portion 16. The first connecting portion 16 is substantially hollow columnar. The first connecting portion 16 is substantially perpendicularly coupled to an inner central portion of the first case 10, and an end of the first connecting portion 16 away from the first case 10 includes a first holding portion 162. The first holding portion 162 is a flange extending around an outer periphery of the end of the first connecting portion 16. The first holding portion 162 includes at least one first sliding portion 164. In at least one embodiment, an outer periphery of the first holding portion 162 includes two first sliding portions 164, and each first sliding portion 164 includes a protrusion 166.

In at least one embodiment, the second case 12 is substantially hemispherical and cooperatively defines a receiving space 20 with the first case 10. The second case 12 includes a second connecting portion 18. The second connecting portion 18 is substantially hollow columnar and coupled substantially perpendicularly to an inner central portion of the second case 12. An end of the second connecting portion 18 away from the second case 12 includes a second holding portion 182. The second holding portion 182 is a flange extending around an inner periphery of the end of the second connecting portion 18.

Figure 2:
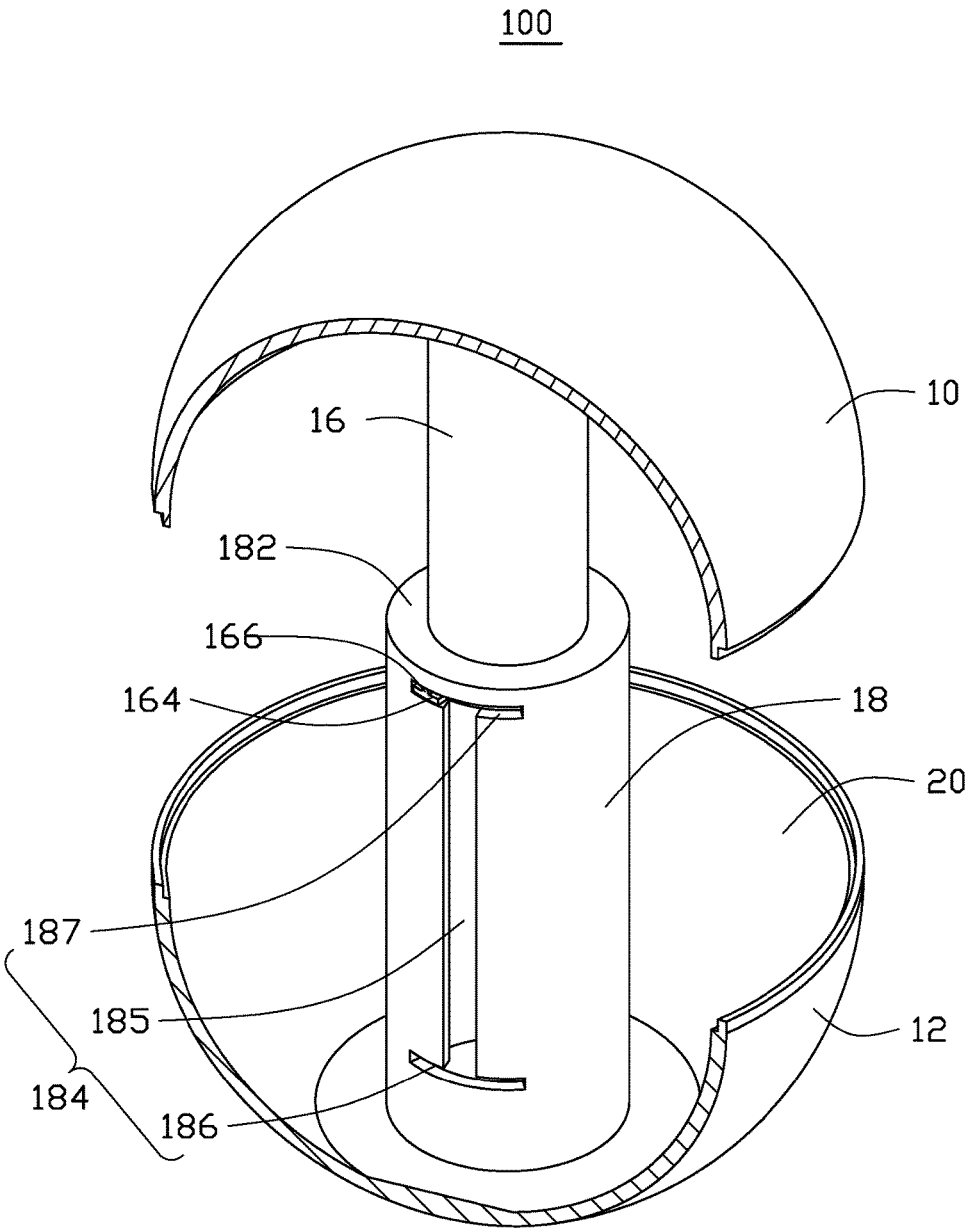
FIG. 2 is a partial cutaway view of a first connector and a second connector of the storage device.

A side of the second connecting portion 18 defines at least one slot 184. In at least one embodiment, the second connecting portion 18 defines two slots 184. Referring to FIG. 2, each slot 184 is substantially sideways H-shaped. The slot 184 includes a sliding section 185, a first holding section 186, and a second holding section 187. The sliding section 185 is defined along an axial direction of the second connecting portion 18. The first holding section 186 is defined adjacent to the end of the second connecting portion 18 coupled to the second case 12. The second holding section 187 is defined adjacent to the second holding portion 182. The first holding section 186 and the second holding section 187 are substantially parallel. The first holding section 186 and the second holding section 187 are substantially perpendicular to the sliding section 185 and extend from both sides of both ends of the sliding section 185.

Referring again to FIG. 2, a diameter of the second connecting portion 18 is larger than a diameter of the first connecting portion 16. The first connecting portion 16 is received within the second connecting portion 18. When the first connecting portion 16 is received within the second connecting portion 18, the first sliding portion 164 is slidably received within the slot 184, such that the first connecting portion 16 and the second connecting portion 18 can telescopically extend or contract or move transversely to each other, thereby switching the storage device 100 between an open state and a closed state. In detail, when the first sliding portion 164 is received within the sliding section 185 of the slot 184, the first connecting portion 16 and the second connecting portion 18 can telescopically extend or contract. When the first sliding portion 164 is slid to arrive at a junction of the sliding section 185 and the first holding section 186, the first case 10 and the second case 12 are locked closed by rotating the first case 10 relative to the second case 12 to cause the first sliding portion 164 to slide within the first holding section 186 of the slot 184. Thus, the first sliding portion 164 is prevented from sliding along the axial direction of the second connecting portion 18. When the first sliding portion 164 is slid to arrive at a junction of the sliding section 185 and the second holding section 187, the first case 10 and the second case 12 are locked in an open state by rotating the first case 10 relative to the second case 12 to cause the first sliding portion 164 to slide within the second holding section 187 of the slot 184. Thus, the first sliding portion 164 is prevented from sliding along the axial direction of the second connecting portion 18. Furthermore, when the first sliding portion 164 slides along the sliding section 185, the first holding portion 162 and the second holding portion 182 prevent the first connecting portion 16 from sliding out of the second connecting portion 18.

Figure 3:
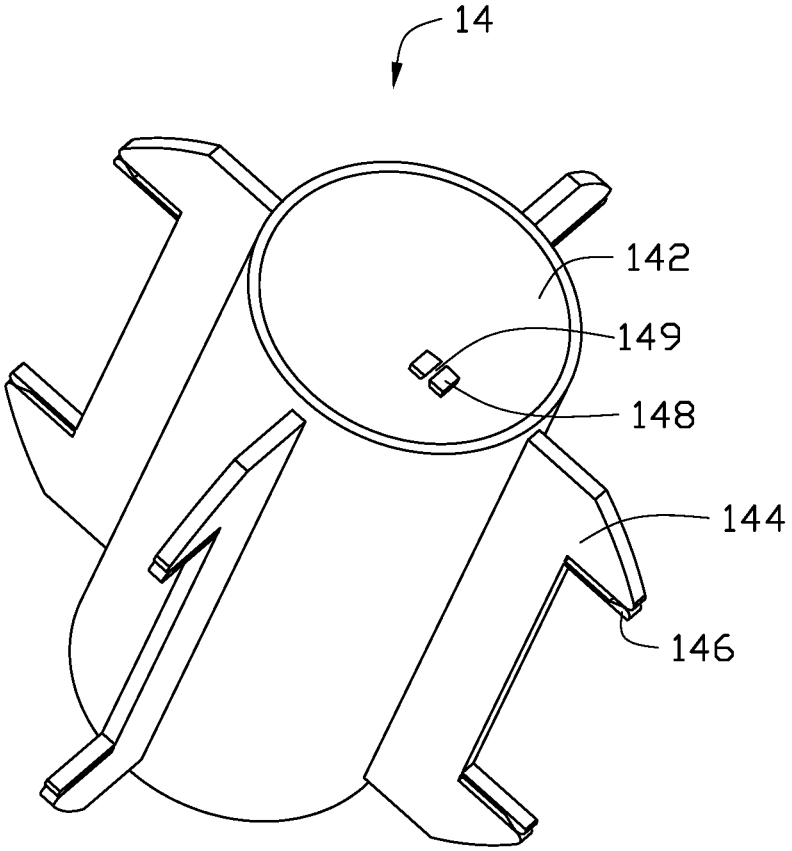
FIG. 3 is an isometric view of a winding body of the storage connector.

Referring to FIG. 3, the winding body 14 includes a main portion 142 and at least one winding portion 144. The main portion 142 is substantially hollow columnar. A diameter of the main portion 142 is greater than the diameter of the second connecting portion 18, and the main portion 142 is sleeved on the second connecting portion 18. In at least one embodiment, the main portion 142 includes two second sliding portion 148 arranged on an inner wall of the main portion 142. The two second sliding portions 148 are spaced apart and cooperatively define a gap 149. The second sliding portions 148 are received within the slot 184.

The winding portion 144 is arranged on an outer surface of the main portion 142. In at least one embodiment, there are four winding portions 144 arranged around the main portion 142 for winding the wired headphones 30. The number of winding portions 144 determines a number of times required to fully wind the wired headphones 30 and can be adjusted according to actual needs. A microphone, a plug, ear buds, or other components of the wired headphones 30 can be placed in a space between adjacent winding portions 144. In at least one embodiment, each winding portion 144 includes a grasping portion 146 protruding from each of opposite ends of the winding portion 144 for grasping the ear buds or plug of the wired earphones 30.

Figure 4:
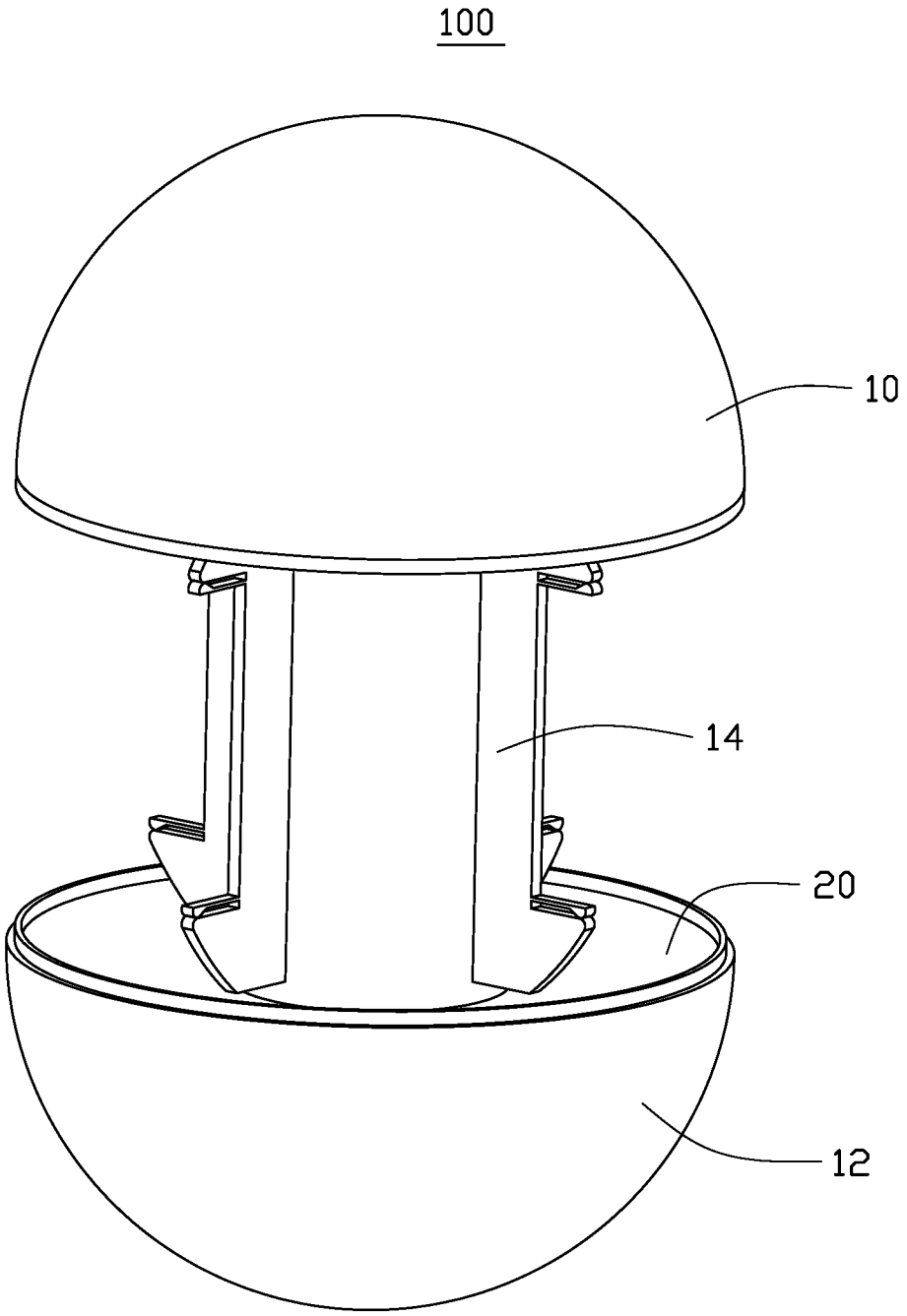
FIG. 4 is an isometric view of the storage body in an open state.
Figure 5:
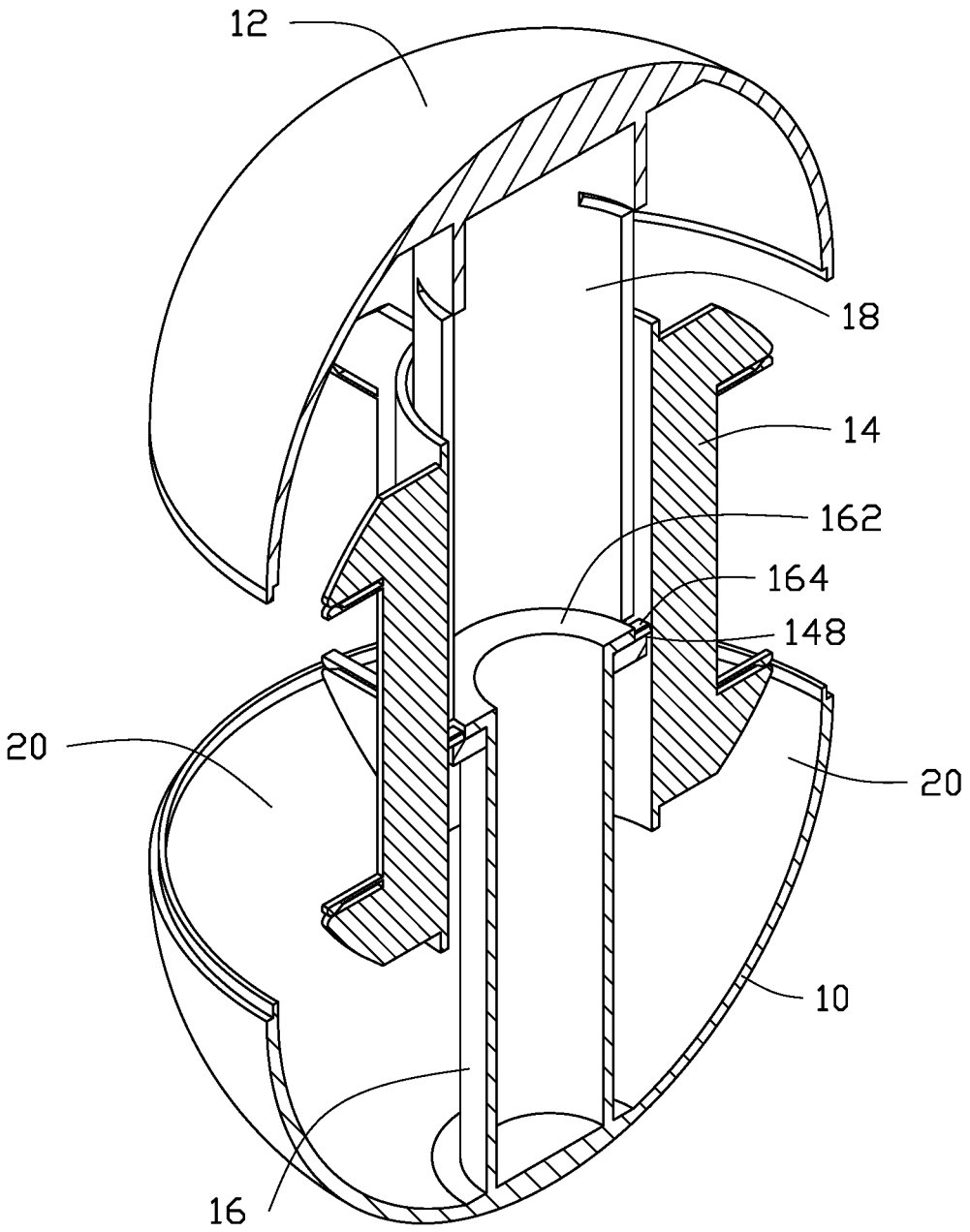
FIG. 5 is a cutaway view of the storage body of FIG. 4.

Referring to FIG. 4 and FIG. 5, in assembly, the winding body 14 is sleeved over the second connecting portion 18, such that the second sliding portions 148 are received within the sliding section 185 of the slot 184. Then, the first holding portion 162 is passed through the second holding portion 182 to receive the first connecting portion 16 within the second connecting portion 18, and the second sliding portion 164 is received within the sliding section 185 of the slot 184. Referring to FIG. 5, the protrusion 166 of the first sliding portion 164 is received in the gap 149 between the second sliding portions 148. Thus, the second sliding portions 148 can slide with the first sliding portion 164 within the slot 184.

Figure 6:
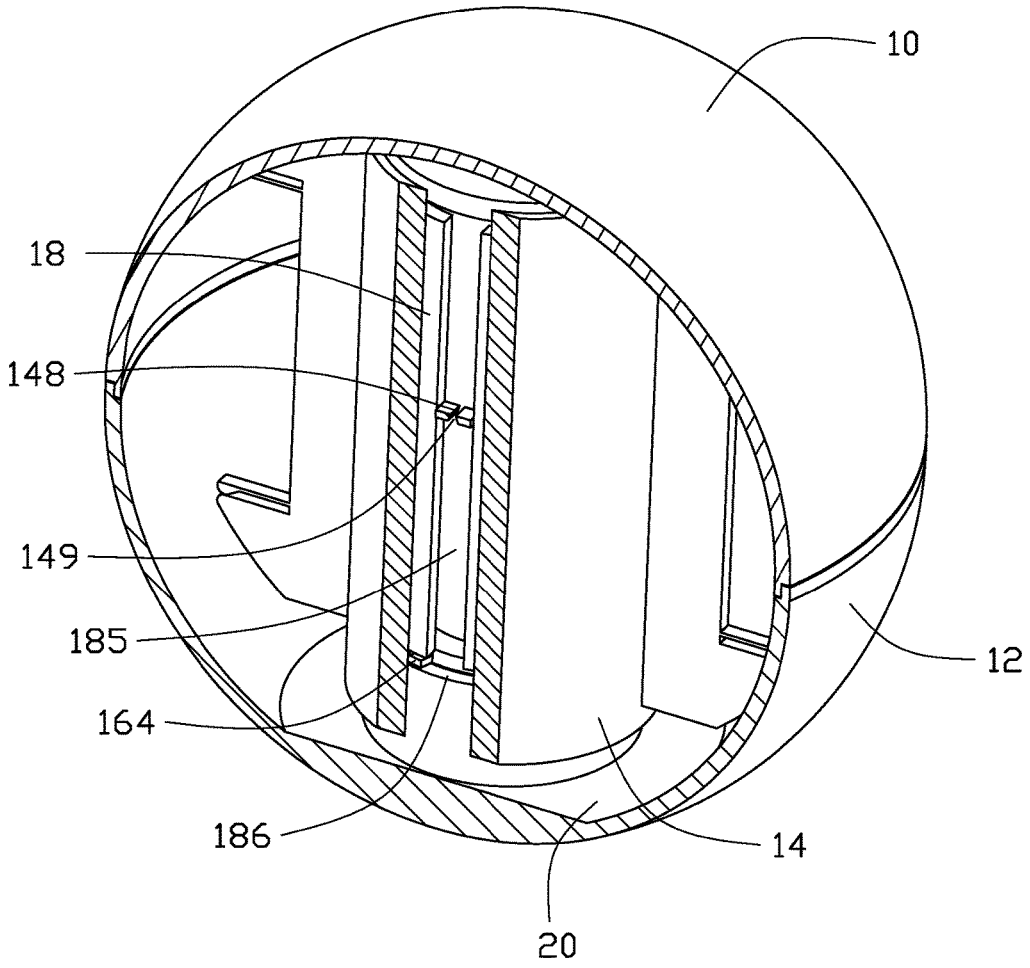
FIG. 6 is a cutaway view of the storage body in a closed state.

Referring to FIG. 6, when the storage device 100 is in the closed state, the first sliding portion 164 is received within the first holding section 186. To open the storage device 100, the first case 10 is rotated relative to the second case 12 to move the first sliding portion 164 to the junction between the sliding section 185 and the first holding section 186, then the first case 10 or the second case 12 is pulled to move the first sliding portion 164. The protrusion 166 of the first sliding portion 164 is received in the gap 149 between the second sliding portions 148, and the second sliding portions 148 move with the first sliding portion 164 along the sliding section 185. The winding body 14 is caused to move with the first connecting portion 16 to be in the open state. When the first sliding portion 164 is moved to the junction between the sliding section 185 and the second holding section 187, the first case 10 is rotate relative to the second case 12 to cause the first sliding portion 164 to move within the second holding section 187, thereby locking the storage device 100 in the open state.

Referring to FIG. 7, when the wired earphones 30 are wound on the winding body 14, the plug and the ear buds are grasped by the grasping portions 146. When the earphones 30 are securely wound, the first case 10 is rotated relative to the second case 12 to move the first sliding portion 164 to the junction between the sliding section 185 and the second holding section 187, the first case 10 or the second case 12 is pushed to move the first sliding block 164 to the junction between the sliding section 185 and the first holding section 186, and then the first case 10 is rotated relative to the second case 12 to move the sliding block 164 into the first holding section 186, thereby locking the storage device 100 in the closed state.

The storage device 100 is a simple structure and can safely store the wired earphones 30 within the receiving space 20. Therefore, a life of the wired earphones 30 can be extended.

In other embodiments, the storage device 100 can be used to store other articles that are easily tangled, such as a necklace or other objects of the like.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A storage device comprising:

a first case comprising a first connecting portion;

a second case comprising a second connecting portion; and a winding body for winding an object thereon;

wherein the first connecting portion is slidably coupled within the second connecting portion; and wherein the winding body is sleeved over the second connecting portion, an end of the first connecting portion is coupled to an inner side of the first case; the first connecting portion comprises at least one first sliding portion; an end of the second connecting portion is coupled to an inner side of the second case; a side of the second connecting portion defines at least one slot a diameter of the first connecting portion is smaller than a diameter of the second connecting portion; the first connecting portion is received within the second connecting portion; and the at least one first sliding portion is slidably received within the at least one slot, the winding body comprises a main portion and a winding portion; a diameter of the main portion is greater than the diameter of the second connecting portion; the main portion is sleeved over the second connecting portion; the winding portion is arranged on a side of the main portion for winding the object thereon, the main portion comprises two second sliding portions protruding from an inner wall of the main portion; the second sliding portions are received within the slot and slide with the first sliding portion within the slot.

2. The storage device of claim 1, wherein the first case and the second case are each semispherical; the first case and the second case cooperatively define a receiving space for receiving the object therein.

3. The storage device of claim 1, wherein an end of the first connecting portion away from the first case comprises a first holding portion; the first holding portion is a flange extending around an outer periphery of the end of the first connecting portion; the first sliding portion is arranged on the first holding portion.

4. The storage device of claim 3, wherein an end of the second connecting portion away from the second case comprises a second holding portion; the second holding portion is a flange extending around an inner periphery of the end of the second connecting portion; the first holding portion and the second holding portion cooperatively prevent the first connecting portion from sliding out of the second connecting portion.

5. The storage device of claim 1, wherein the winding portion comprises a grasping portion for grasping ear buds and a plug of wired headphones.

6. The storage device of claim 1, wherein the slot comprises a sliding section defined along an axial direction of the second connecting portion; when the first sliding portion slides within the slot, the first connecting portion and the second connecting portion telescopically extend or contract.

7. The storage device of claim 6, wherein the slot further comprises a first holding section and a second holding section; the first holding section is defined adjacent to the end of the second connecting portion coupled to the second case; the second holding section is defined adjacent to the second holding portion; the first holding section is parallel to the second holding section.

8. The storage device of claim 7, wherein the first holding section and the second holding section are perpendicular to the sliding section and extend from both sides of both ends of the sliding section; the sliding section, the first holding section, and the second holding section are cooperatively sideways H-shaped.

9. The storage device of claim 8, wherein when the first sliding portion is slid to arrive at a junction of the sliding section and the first holding section, the first case and the second case are locked in a closed state by rotating the first case relative to the second case to cause the first sliding portion to slide within the first holding section of the slot; when the first sliding portion is slid to arrive at a junction of the sliding section and the second holding section, the first case and the second case are locked in an open state by rotating the first case relative to the second case to cause the first sliding portion to slide within the second holding section of the slot.

* * * * *